United States Patent [19]

Phillips

[11] Patent Number: 4,737,159

[45] Date of Patent: Apr. 12, 1988

[54] CORROSION INHIBITOR FOR LIQUID FUELS

[75] Inventor: Tayman A. Phillips, Pennsville, N.J.

[73] Assignee: E. I. Du Pont de Nemours and Company, Wilmington, Del.

[21] Appl. No.: 625,912

[22] Filed: Jun. 29, 1984

[51] Int. Cl.[4] ..... C10L 01/02

[52] U.S. Cl. ..... 44/53; 44/70; 44/71; 44/72; 44/73; 252/390; 252/392; 252/394; 252/396

[58] Field of Search ..... 44/70, 66, 53, 56, 63, 44/71, 73; 252/390, 392, 394, 396

[56] References Cited

U.S. PATENT DOCUMENTS

| | | | |
|---|---|---|---|
| 2,181,121 | 11/1939 | Downing | 44/73 |
| 2,181,122 | 11/1939 | Downing | 252/403 |
| 2,284,267 | 5/1942 | Downing | 44/73 |
| 2,657,982 | 11/1953 | Hill et al. | 44/70 |
| 2,667,408 | 1/1954 | Kleinholz | 44/70 |
| 2,813,080 | 11/1957 | Bartlett | 44/73 |
| 2,922,708 | 1/1960 | Lindstrom et al. | 44/66 |
| 2,993,772 | 7/1961 | Stromberg | 44/70 |
| 3,071,451 | 1/1963 | Schmerling | 44/73 |
| 3,282,836 | 11/1966 | Miller et al. | 44/70 |
| 3,342,570 | 9/1967 | Kautsky | 44/69 |
| 3,346,354 | 10/1967 | Kautsky | 44/63 |
| 3,421,867 | 1/1969 | Heisler et al. | 44/70 |
| 3,447,918 | 9/1969 | Amick | 44/70 |
| 3,454,381 | 7/1969 | Eckert | 44/66 |
| 3,516,806 | 9/1970 | Malec | 44/72 |
| 3,560,173 | 2/1971 | Coffey | 44/56 |
| 3,561,936 | 2/1971 | Eckert | 44/58 |
| 3,687,644 | 8/1972 | Delafield et al. | 44/56 |
| 3,704,109 | 11/1972 | Newman et al. | 44/66 |
| 3,707,362 | 12/1972 | Zimmerman et al. | 44/72 |
| 3,720,615 | 3/1973 | Izumi et al. | 252/33 |
| 3,894,849 | 7/1975 | Polss | 44/66 |
| 3,925,030 | 12/1975 | Garth | 44/56 |
| 3,977,994 | 8/1976 | Geiser | 252/392 |
| 4,128,403 | 12/1978 | Honnen | 44/71 |
| 4,173,456 | 11/1979 | Scheule et al. | 44/66 |
| 4,185,594 | 1/1980 | Perilstein | 44/53 |
| 4,208,190 | 6/1980 | Malec | 44/53 |
| 4,214,876 | 7/1980 | Garth et al. | 44/66 |
| 4,242,099 | 12/1980 | Malec | 44/53 |
| 4,426,208 | 1/1984 | Perilstein | 44/70 |
| 4,440,545 | 4/1984 | Weidig | 44/70 |
| 4,448,586 | 5/1984 | Weidig | 44/55 |
| 4,511,367 | 4/1985 | Knapp | 44/56 |

*Primary Examiner*—William R. Dixon, Jr.
*Assistant Examiner*—Margaret B. Medley
*Attorney, Agent, or Firm*—Craig H. Evans

[57] ABSTRACT

A corrosion inhibitor for use in liquid hydrocarbon fuels or gasoline oxygenate blends is disclosed. The corrosion inhibitor contains from 35 to 70 wt % of a monoalkenylsuccinic acid wherein the alkenyl group has 8 to 18 carbon atoms, from about 30 to 65 wt % of an aliphatic or cycloaliphatic amine containing 2 to 12 carbon atoms and up to 50 wt % of total solvents consisting of aromatic hydrocarbons and alcohols of 1 to 4 carbons per molecule.

The corrosion inhibitor can also be used in inhibited alcohol compositions such as those used in gasoline oxygenate blends.

19 Claims, No Drawings

CORROSION INHIBITOR FOR LIQUID FUELS

BACKGROUND OF THE INVENTION

1. Field of the Invention

The present invention relates to a corrosion inhibitor composition, an inhibitor-solvent concentrate of the inhibitor composition in a solvent consisting of aromatic hydrocarbons and/or alcohols, and concentrates of the inhibitor composition or inhibitor-solvent concentrate with detergents, metal deactivators and gasoline antioxidants. The invention also relates to an inhibited alcohol containing the inhibitor composition, the inhibitor-solvent concentrate, or concentrates with detergents, metal deactivators and/or gasoline antioxidants. The invention further relates to the use of a concentrate of the corrosion inhibitor and a polymerized unsaturated aliphatic monocarboxylic acid, alone and together with detergents, metal deactivators and gasoline antioxidants in gasoline oxygenate blends.

Corrosion inhibitors are used in fuels to prevent corrosion in storage tanks and pipelines. The corrosion problem in storage and pipeline systems usually stems from water contamination, but, in the case of gasoline oxygenate blends, also stems from acidic impurities in the oxygenate. Corrosion inhibitors intended for use in fuel systems must be effective in very small quantities so as to avoid adverse effects such as adding to the gum component of the fuel and so as to to minimize costs. Additionally, the corrosion inhibitor, in the amounts employed, must not emulsify water.

2. Prior Art

U.S. Pat. No. 3,894,849 discloses gasoline containing an acylated polyalkylene polyamine as a detergent, antiicing, antirust agent which also exhibits lower engine detergent properties.

U.S. Pat. No. 4,214,876 discloses a corrosion inhibitor for hydrocarbon fuels comprising a polymerized unsaturated aliphatic carboxylic acid having about 16–18 carbon atoms and a monoalkenylsuccinic acid wherein the alkenyl group contains 8–18 carbon atoms.

U.S. Pat. No. 4,426,208 discloses a corrosion inhibitor for gasohol comprising at least one polymerized unsaturated aliphatic carboxylic acid having from about 16 to 18 carbon atoms per molecule and an aliphatic dicarboxylic acid having from 2 to about 10 carbon atoms.

U.S. Pat. No. 4,440,545 discloses a corrosion inhibitor for gasohol comprising a hydrocarbyl succinic acid or anhydride having from about 8–30 carbon atoms.

SUMMARY OF THE INVENTION

The present invention relates to a corrosion inhibitor for hydrocarbon fuels or hydrocarbon fuels containing one or more alcohols. The corrosion inhibitor comprises 35 to 70 wt % of a monoalkenylsuccinic acid in which the alkenyl group contains 8 to 18 carbon atoms, from 30 to 65 wt % of an aliphatic or cycloaliphatic amine containing 2 to 12 carbon atoms and optionally up to 50 wt % of solvents consisting of aromatic hydrocarbons and alcohols of 1 to 4 carbons.

The present invention also relates to an inhibited alcohol of 1 to 4 carbons containing 80 to 250 mg of one or more of the corrosion inhibitors noted above per liter of alcohol, and optionally (1) 100 to 350 mg/liter of a detergent such as a generally liquid, acylated polyalkylene polyamine which is substantially free of nitrogen-containing cyclic groups and is of the formula

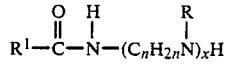

wherein R is selected from H and

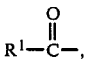

at least two R groups are

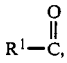

$R^1$ is $C_{9-12}$ saturated or unsaturated aliphatic hydrocarbyl, n is 2 or 3 and x is 2–6;

(2) 10 to 30 mg/liter of a metal deactivator such as a condensation product of salicylaldehyde and an aliphatic diamine, particularly N,N'-bis(salicylidene-1,2-diaminopropane);

(3) 80 to 250 mg/liter of a N,N'-di(sec. alkyl)-p-phenylenediamine type gasoline antioxidant;

(4) 35 to 100 mg/liter of at least one polymerized unsaturated aliphatic monocarboxylic acid having 16 to 18 carbons per molecule, particularly a polymerized tall oil fatty acid such as is commercially available.

The present invention further relates to the use in gasoline oxygenate blends consisting of the following concentrations (expressed in milligrams of additive per liter of gasoline) of additives:

(1) 4.0 to 12.5 mg/liter of monoalkenylsuccinic acid and, an aliphatic or cycloaliphatic amine containing 2 to 12 carbons and, optionally, a hydrocarbon solvent consisting of an aromatic hydrocarbon, an alcohol containing 1 to 4 carbon atoms or mixtures thereof and, optionally;

(2) 1.7 to 5.0 mg/liter of at least one polymerized unsaturated aliphatic monocarboxylic acid having 16 to 18 carbons per molecule, particularly a polymerized tall oil fatty acid such as is commercially available and, optionally;

(3) 0.5 to 1.5 mg/liter of a N,N'-bis(salicylidene-polyamine), a condensation product of salicylaldehyde and an aliphatic diamine, particularly N,N'-bis(salicylidene-1,2-diaminopropane) and, optionally;

(4) 5.0 to 17.5 mg/liter of an acylated polyalkylene polyamine which is substantially free of nitrogen containing cyclic groups and is of the formula

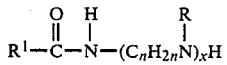

wherein R is selected from H and

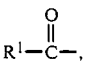

at least two R groups are $$R^1-\overset{O}{\overset{\|}{C}},$$

$R^1$ is $C_{9-21}$ saturated or unsaturated aliphatic hydrocarbyl, n is 2 or 3 and x is 2–6, and optionally;

(5) 4.0 to 12.5 mg/liter of a N,N'-di(sec. alkyl)-p-phenylenediamine type antioxidant.

DETAILED DESCRIPTION

The monoalkenylsuccinic acids contemplated for use herein are well known in the art. These acids are readily prepared by the condensation of an olefin with maleic anhydride followed by hydrolysis (see U.S. Pat. Nos. 2,133,734 and 2,741,597). Suitable monoalkenylsuccinic acids include octenylsuccinic acid, decenylsuccinic acid, undecenylsuccinic acid, dodecenylsuccinic acid, pentadecenylsuccinic acid, octadecenylsuccinic acid and isomers thereof having alkenyl groups of various hydrocarbon structures. The preferred monoalkenylsuccinic acid is dodecenylsuccinic acid, most preferably dodecenylsuccinic acid prepared from propylene tetramer.

The amines useful in the present invention are aliphatic and cycloaliphatic amines (containing 2 to 12 carbon atoms) of the formula $R_1R_2NR_3$ where $R_1$ and $R_2$ are alkyl or alkylene groups, and $R_3$ is an alkyl group or hydrogen. $R_1$ and $R_2$ may be cojoined and may be hydrocarbons or heterocyclic containing an oxygen or other nitrogen atoms. The preferred amines are N,N-dimethylcyclohexylamine, morpholine and triethanolamine.

Optionally, the corrosion inhibitor of the present invention contains a solvent consisting of an aromatic hydrocarbon and alcohols of 1 to 4 carbons per molecule, preferably xylene and methanol.

The corrosion inhibitor composition may be combined with detergents such as a acylated polyalkylene polyamine which is substantially free of nitrogen containing cyclic groups and is of the formula $$R^1-\overset{O}{\overset{\|}{C}}-\overset{H}{\overset{|}{N}}-(C_nH_{2n}\overset{R}{\overset{|}{N}})_xH$$

wherein R is selected from H and $$R^1-\overset{O}{\overset{\|}{C}}-,$$

at least two R groups are $$R^1-\overset{O}{\overset{\|}{C}},$$

$R^1$ is $C_{9-21}$ saturated or unsaturated aliphatic hydrocarbyl, n is 2 or 3 and x is 2–6, preferably wherein n is 2, x is 4 and R' is $C_{17}$ (see U.S. Pat. No. 3,894,849); metal deactivators such as N,N'-bis(salicylidene-polyamines), condensation products of salicylaldehyde and aliphatic diamines, particularly 1,2-diaminopropane which yields N,N'-bis(salicylidene-1,2-diaminopropane) (see U.S. Pat. Nos. 2,181,121, 2,181,122, 2,284,267, 2,813,080 and 3,071,451); and gasoline antioxidants such as N,N'-di(sec. alkyl)-p-phenylenediamine, particularly N,N'-di(sec. butyl)-p-phenylenediamine, N,N'-di(isopropyl)-p-phenylenediamine and N,N'-di(1,4-dimethylpentyl)-p-phenylenediamine.

The corrosion inhibitor composition and its various concentrates may be blended in alcohols (to be used in making gasoline-oxygenate blends) in the following concentrations (expressed in milligrams of additive per liter of alcohol);

(1) 80 to 250 mg/liter of the corrosion inhibitor composition of the monoalkenylsuccinic acid, aliphatic or cycloaliphatic amine and, optionally, the aromatic hydrocarbon or alcohol and, optionally;

(2) 100 to 350 mg/liter of a generally liquid, acylated polyalkylene polyamine which is substantially free of nitrogen containing cyclic groups and is of the formula $$R^1-\overset{O}{\overset{\|}{C}}-\overset{H}{\overset{|}{N}}-(C_nH_{2n}\overset{R}{\overset{|}{N}})_xH$$

wherein R is selected from H and $$R^1-\overset{O}{\overset{\|}{C}}-,$$

at least two R groups are $$R^1-\overset{O}{\overset{\|}{C}},$$

$R^1$ is $C_{9-21}$ saturated or unsaturated aliphatic hydrocarbyl, n is 2 or 3 and x is 2–6 (U.S. Pat. No. 3,894,849) and, optionally;

(3) 10 to 30 mg/liter of N,N'-bis(salicylidene-polyamine), a condensation product of salicylaldehyde and aliphatic diamines, particularly N,N'-bis(salicylidene-1,2-diaminopropane) and, optionally;

(4) 80 to 250 mg/liter of a N,N'-di(sec. alkyl)-p-phenylenediamine and, optionally;

(5) 35 to 100 mg/liter of at least one polymerized unsaturated aliphatic monocarboxylic acid having 16 to 18 carbons per molecule, particularly a polymerized tall oil fatty acid such as is commercially available.

The hydrocarbon fuels into which the compositions of this invention are incorporated to provide corrosion inhibiting characteristics are normally liquid hydrocarbon fuels boiling in the range of about 20°–375° C. and include motor gasolines, aviation gasolines, kerosenes, diesel fuels, and fuel oils. The hydrocarbon fuel compositions containing the compositions of this invention as corrosion inhibitors may also contain conventional additives such as antiknock compounds, antioxidants, metal deactivators, other corrosion inhibitors, antistatic agents, antiicing agents, detergents, dispersants, thermal stabilizers, dyes and the like.

The hydrocarbon fuel may also contain small proportions, e.g., 1 to 10 vol %, of one or more octane-boosting and fuel-extending oxygenates such as a $C_1$–$C_4$ alcohol, exemplified by methanol, ethanol, isopropyl alcohol, n-butanol and tertiary-butyl alcohol and/or a tertiary-alkyl alkyl ether, exemplified by tertiary-butyl methyl ether and tertiary-amyl methyl ether.

The hydrocarbon fuel/oxygenate blends sometimes contain corrosive, e.g., acidic byproducts of the processes used to make the oxygenate component. Sometimes the blends, although initially free of corrosive components, develop acidity in storage, particularly over extended periods of time. The corrosion inhibitor compositions of the invention are especially effective in such corrosive fuel blends. They function by substantially different mechanisms when performing as a corrosion inhibitor in these gasoline oxygenate blends than when in fuel oil where water bottoms are the primary problem. As an inhibitor in fuel oil water bottoms, the amine component forms a polar salt with the organic acid inhibitor and acts to transport the inhibitor into the water phase. As an inhibitor in gasoline-oxygenate-blend systems, the amine component acts by neutralizing acidic impurities in the oxygenate, thus allowing the organic acid inhibitor to be effective.

The compositions of the invention incorporated into hydrocarbon fuels in the range of about 0.0002–0.002 percent by weight (0.5–5 pounds per thousand barrels, ptb) provide satisfactory corrosion-inhibiting properties. Concentrations higher than about 0.002% can be used but do not appear to provide further benefits. The prefered concentration range is about 0.0003–0.002 percent by weight (0.75–5 ptb), the more preferred range is about 0.0006–0.0018 percent by weight (1.5–4.5 ptb).

The corrosion-inhibitor compositions of the invention can be added to the hydrocarbon fuels by any means known in the art for incorporating small quantities of additives into hydrocarbon fuels. The components can be added separately or they can be combined and added together. It is convenient to utilize the present compositions as concentrates, that is, as concentrated solutions in suitable solvents. When used as a concentrate, the additive composition will contain about 50–85% by weight, of a combination of the components and about 15–50% by weight of a solvent. The preferred concentrate will have about 55–80% by weight of the combination and about 20–45% by weight of solvent. The most preferred concentrate will have about 55–75% by weight of the combination and about 25–45% of solvent.

Suitable solvents are normally liquid organic compounds boiling in the hydrocarbon fuel boiling range, particularly hydrocarbons and alcohols, and include hexane, cyclohexane, heptane, octane, isooctane, benzene, toluene, xylene, methanol, ethanol, propanol, butanol, gasolines, jet fuels, fuel oils and the like. Mixtures of solvents can also be used. The preferred solvent is a mixture of lower alcohols and aromatic hydrocarbons.

EXAMPLES

Example 1

A solution containing 56.7 wt % "Acintol" FA-7002 which is a polymerized tall oil fatty acid, 13.3 wt % dodecenylsuccinic acid and 30 wt % mixed xylenes. One part of N,N-dimethylcyclohexylamine is added to three parts of the solution prepared above to form corrosion inhibitor A.

Example 2

A solution containing 22.8 wt % dodecenylsuccinic acid, 36.3 wt % triethanolamine, 25.5 wt % methanol and 15.4 wt % xylene is prepared. This is identified as corrosion inhibitor B.

Example 3

A solution of 38.3 wt % dodecenylsuccinic acid, 18.9 wt % morpholine, 22.5 wt % methanol and 20.3 wt % xylene is prepared. This is identified as corrosion inhibitor C.

Antirust Evaluation

Antirust performances of the compositions of this invention were determined according to NACE (National Association of Corrosion Engineers) Standard TM-01-72, "Antirust Properties of Petroleum Products Pipeline Cargoes". The test method is essentially the ASTM D665 method modified to determine antirust properties of gasolines and distillate fuels in movement through product pipelines. The method involves immersing a cylindrical steel specimen in the test fuel, which is stirred 4 hours at 38° C. Distilled water is added to the test fuel after the first half hour. The antirust rating is based on the portion of the test specimen that has changed after the 4 hours and is expressed using the following rating scale:

| Rating | Proportion of Test Surface Rusted |
|---|---|
| A | None |
| B++ | Less than 0.1% (2 or 3 spots of no more than 1 mm diameter) |
| B+ | Less than 5% |
| B | 5–25% |
| C | 25–50% |
| D | 50–75% |
| E | 75–100% |

Ordinarily a rating of B+ or B++ is adequate to control corrosion in active pipeline, although a rating of A is obviously more desirable.

Corrosion inhibitor A is tested in gasohol formed of 90 volume percent RE-117B Ref. Gasoline which is commercially available, having the following properties:

| | | |
|---|---|---|
| ASTM D 287 | Gravity °API 60 F | 62.8 |
| ASTM D 287 | Density lb/gal 60 F | 6.06 |
| ASTM D 323 | Reid Vapor Pressure, lb | 12.6 |
| ASTM D 86 | Distillation, F | |
| | Initial Boiling Point | 79 |
| | 50% Recovered | 206 |
| | End Point | 400 |

and 10 volume percent 200 proof ethanol denatured by 5% UL Gasoline. The results are reported in Table I.

TABLE I

| Additive | Concentration lb/1000 bbl | NACE Rust Rating |
|---|---|---|
| Control | 0 | E 95 |
| A | 0.5 | C 30 |
| A | 1.0 | B 20 |
| A | 2.0 | A 0 |

Corrosion inhibitors A, B and C are tested in RE-117B Reference Gasoline and the results are reported in Table II.

TABLE II

| Additive | Concentration lb/1000 bbl | NACE Rust Rating |
|---|---|---|
| Control | 0 | E 85 |
| A | 1 | B 15 |
| B | 1 | B+ 4 |
| C | 1 | A 0 |

Corrosion inhibitors are tested in a difficult to treat Diesel Fuel P82-30 which is commercially available, having the following properties:

| | | |
|---|---|---|
| ASTM D 287 | Gravity °API 60 F | 31.6 |
| ASTM D 287 | Density lb/gal 60 F | 7.22 |
| ASTM D 86 | Distillation, F | |
| | Initial Boiling Point | 370 |
| | 50% Recovered | 473 |
| | End Point | 666 |

The results are reported in Table III.

TABLE III

| Additive | Concentration lb/1000 bbl | NACE Rust Rating |
|---|---|---|
| Control | 0 | E 90 |
| A | 1 | D 50 |
| A | 2 | B 20 |
| B | 1 | B 20 |
| B | 2 | B+ 3 |
| C | 1 | A 0 |
| C | 2 | A 0 |

I claim:

1. A corrosion inhibitor composition for liquid hydrocarbon fuels containing 1.0 to 10 volume percent of one or more alcohols comprising, by weight, (a) about 35% to 70% of at least one monoalkenylsuccinic acid in which the alkenyl group has 8 to 18 carbons; and (b) about 30% to 65% of an aliphatic or cycloaliphatic amine containing 2 to 12 carbon atoms in a hydrocarbon solvent consisting of an aromatic hydrocarbon, an alcohol containing 1 to 4 carbon atoms, or mixture thereof, the ratio of the hydrocarbon solvent to the total of (a) and (b) being about 15:85 to 50:50.

2. The composition of claim 1 wherein the amine is selected from the group consisting of N,N-dimethylcyclohexylamine, morpholine or triethanolamine.

3. The composition of claim 2 wherein the monoalkenylsuccinic acid is dodecenylsuccinic acid.

4. The composition of claim 3 wherein the amine is triethanolamine.

5. The composition of claim 3 wherein the amine is morpholine.

6. The composition of claim 3 wherein the amine is N,N-dimethylcyclohexylamine.

7. The composition of claim 2 wherein the solvent is a mixture of methanol and xylene.

8. A composition comprising the composition of claim 2 and (i) a composition which is generally liquid, acylated polyalkylene polyamine which is substantially free of nitrogen containing cyclic groups and is of the formula $$R^1-\overset{\overset{\displaystyle O}{\|}}{C}-\overset{\overset{\displaystyle H}{|}}{N}-(C_nH_{2n}\overset{\overset{\displaystyle R}{|}}{N})_xH$$

wherein R is selected from H and $$R^1-\overset{\overset{\displaystyle O}{\|}}{C}-,$$

at least two R groups are $$R^1-\overset{\overset{\displaystyle O}{\|}}{C},$$

$R^1$ is $C_{9-21}$ saturated or unsaturated aliphatic hydrocarbyl, n is 2 or 3 and x is 2–6, wherein the ratio of the composition of (i) to the composition of claim 2 is from about 0.53:1 to 1.4:1.

9. The composition of claim 8 wherein, in composition (i), n is 2, x is 4 and R′ is $C_{17}$.

10. A composition comprising the composition of claim 2 and (i) a composition of a N,N′-di(sec. alkyl)-p-phenylenediamine, wherein the ratio of the composition of (i) to the composition of claim 2 is from about 0.42:1 to 2.0:1.

11. The composition of claim 10 wherein composition (i) is of the group N,N′-di(sec. butyl)-p-phenylenediamine, N,N′-di(isopropyl)-p-phenylenediamine, or N,N′-di(1,4-dimethylpentyl)-p-phenylenediamine.

12. A composition comprising the corrosion inhibitor composition of claim 1, composition (i) of claim 8, composition (i) of claim 10 and (i) a composition of N,N′-bis(salicylidene-polyamine), wherein the ratio of the composition (i) of claim 8 to the composition (i) of claim 10 to the composition (i) of this claim to the composition of claim 1 is from about 0.53:0.42:0.08:1 to 1.4:2.0:0.25:1.

13. An inhibited alcohol composition for use in making gasoline-oxygenate blends containing an alcohol of 1 to 4 carbon atoms and about 80 to 250 mg of the composition of claim 1 per liter of alcohol.

14. The inhibited alcohol composition of claim 13 wherein the alcohol is methanol.

15. An inhibited alcohol composition comprising the composition of claim 13 and from about 35 to 100 mg of a composition of at least one polymerized unsaturated aliphatic monocarboxylic acid having 16 to 18 carbon atoms per liter of alcohol.

16. The inhibited alcohol composition of claim 15 wherein the polymerized unsaturated aliphatic monocarboxylic acid is a polymerized tall oil fatty acid.

17. A gasoline oxygenate blend containing about 4 to 12.5 mg of the composition of claim 1 per liter of gasoline.

18. A gasoline oxygenate blend containing about one part of the composition of claim 15 or 16 to 20 parts gasoline.

19. A composition comprising (a) the corrosion inhibitor of claim 1;

(b) a composition which is generally liquid, acylated polyalkylene polyamine which is substantially free of nitrogen containing cyclic groups and is of the formula $$R^1-\overset{\overset{\displaystyle O}{\|}}{C}-\overset{\overset{\displaystyle H}{|}}{N}-(C_2H_4\overset{\overset{\displaystyle R}{|}}{N})_4H$$

wherein R is selected from H and $$R^1-\overset{\overset{\displaystyle O}{\|}}{C},$$

at least two R groups are $$R^1-\overset{\overset{\displaystyle O}{\|}}{C},$$

and $R^1$ is $C_{17}$ saturated or unsaturated aliphatic hydrocarbyl;

(c) a composition selected from the group consisting of N,N'-di(sec. butyl)-p-phenylenediamine, N,N'-di(isopropyl)-p-phenylenediamine, and N,N'-di(1,4-dimethylpentyl)-p-phenylenediamine; and (d) a composition of N,N'-bis(salicylidene-1,2,-diaminopropane wherein the ratio of b:c:d:a is from about 0.53:0.42:0.08:1 to about 1.4:2.0:0.25:1.

* * * * *